US010299342B1

(12) United States Patent
Reddy et al.

(10) Patent No.: US 10,299,342 B1
(45) Date of Patent: May 21, 2019

(54) INDEPENDENTLY-ADDRESSABLE LIGHT CONTROL RELAY, CONTROLLER INCORPORATING SAME, AND METHOD FOR CONTROLLING SAME

(71) Applicants: Rakesh Reddy, Boca Raton, FL (US); Kevin Doyle, Delray Beach, FL (US); William Kent, Fort Lauderdale, FL (US)

(72) Inventors: Rakesh Reddy, Boca Raton, FL (US); Kevin Doyle, Delray Beach, FL (US); William Kent, Fort Lauderdale, FL (US)

( * ) Notice: Subject to any disclaimer, the term of this patent is extended or adjusted under 35 U.S.C. 154(b) by 0 days.

(21) Appl. No.: 15/998,460

(22) Filed: Aug. 15, 2018

Related U.S. Application Data

(60) Provisional application No. 62/545,979, filed on Aug. 15, 2017.

(51) Int. Cl.

| | |
|---|---|
| ***H05B 33/08*** | (2006.01) |
| ***F21V 23/04*** | (2006.01) |
| ***F21V 23/00*** | (2015.01) |
| ***H05B 37/02*** | (2006.01) |
| ***F21V 23/02*** | (2006.01) |
| *F21W 131/401* | (2006.01) |

(52) U.S. Cl.
CPC ..... *H05B 33/089* (2013.01); *F21V 23/004* (2013.01); *F21V 23/023* (2013.01); *F21V 23/0435* (2013.01); *H05B 33/0863* (2013.01); *H05B 37/0272* (2013.01); *F21W 2131/401* (2013.01)

(58) Field of Classification Search
CPC ..... H05B 37/02; H05B 37/0227; H05B 37/0272; H05B 33/08; H05B 33/0815; H05B 33/0845; H05B 33/0863; H05B 33/089; F21V 23/023; F21V 23/004; F21V 23/0435; F21W 2131/401
USPC ..... 315/151–158, 209 R, 291, 294, 307, 308
See application file for complete search history.

(56) References Cited

U.S. PATENT DOCUMENTS

2004/0195982 A1* 10/2004 Garrity ..... H05B 37/0209 315/312
2008/0197788 A1* 8/2008 Conover ..... H05B 37/029 315/291

* cited by examiner

*Primary Examiner* — Jimmy T Vu
(74) *Attorney, Agent, or Firm* — Glenn E. Gold, P.A.; Glenn E. Gold

(57) ABSTRACT

An improved controller used in connection with pool area and surrounding landscaping low voltage lighting and related low voltage subcomponents, such as lighting, fountains, waterfalls, deck jets, and music or related entertainment devices, incorporates an independently-addressable light control relay, or analogous electronic component, and is implementable as a retrofit replacement for existing controller systems or, alternatively, as a complete new unit for controlling low voltage subcomponents.

9 Claims, 5 Drawing Sheets

INDEPENDENTLY-ADDRESSABLE LIGHT CONTROL RELAY, CONTROLLER INCORPORATING SAME, AND METHOD FOR CONTROLLING SAME

CROSS-REFERENCE TO RELATED APPLICATION

This U.S. non-provisional patent application claims the benefit of, and priority to, U.S. provisional patent application No. 62/545,979, filed on Aug. 15, 2017, the entire contents of which are incorporated-by-reference herein.

FIELD OF THE INVENTION

The present invention generally relates to controllers used in connection with low voltage devices, such as lighting controls for pools, spas, water feature and landscape lighting controls. More particularly, the invention pertains to an improved controller incorporating an independently-addressable light control relay and associated control methods.

BACKGROUND OF THE INVENTION

Pools are a popular recreational item for the average homeowner and have more frequently become both an entertainment and aesthetic feature of homes. With advances in light-emitting diode (LED) technology complex colored lighting has become even more ubiquitous in pools, spas, and water features. For example, swimming pools, spas, and water features have moved several steps beyond their traditional, classic forms in shape, complexity, visual interest and beauty—and so have the techniques and technologies involved in giving them a warm, inviting glow when evening comes. Through years of innovation, experimentation, and refinement with LEDs, lighting is now adding splendor and wonder to the pool/spa experience in compact, unobtrusive packages—a design asset that couldn't even have been imagined just twenty years ago. LED lighting is the lighting of choice for swimming pools because these LEDs can illuminate the pool, spa, water features and other decorative outdoor elements.

The lighting allows homeowners, for example, to control the color and intensity with a remote control operating system. Changing color lights creates visual drama and adds aesthetic beauty to a pool and outdoor living space. Nowadays, it is not uncommon for low voltage systems, such as waterfalls, deck jets, bubblers, and other low-voltage features to function in concert with color-changing LED lighting to create a backyard or pool experience, often incorporating synchronized programming of lighting, music, and other setting features. Lighting control programs not only display a variety of colors but they can generate a variety of individual lighting effects or a series of lighting effects to create shows; that is, synchronized changing colors or effects, which can be pattern based or synchronized to signals and other inputs.

The control of the equipment in accordance with a typical control scheme to produce such coordinated "shows" is conventionally accomplished using a series of independent controller devices each associated with a particular low voltage equipment/device including, but not limited to, pool lighting, water features (e.g. waterfalls, deck jets, etc.) and the like. In accordance with the most common control scheme associated with lighting control programs, such LED colored lights employ a simple toggling mechanism, serially switching power between ON and OFF states a specific number of times in order to set, change, and reset operating modes and output effects. This manual method of control, or control scheme, has conventionally been employed for controlling the operation of various equipment and devices associated with pools and spas, including, for example, pumps, water jets, lights, heaters, active filters and so forth. The corresponding relays or switches being toggled between ON and OFF states are often found in time clocks, both mechanical and digital, housed in one or more enclosures in close proximity to pool and spa equipment, and employ a bus connector coupling arrangement. These invariably include a transformer for converting available alternating current (AC) power supplies to lower voltages and accompanying switching or relay devices to selectively supply this power based on control inputs.

An example of a typical control scheme used for light control in the industry is the use of ON/OFF signal pulses to switch selection of the program controlling the color emissions through the use of an ON/OFF switch or relay for the light. A brief ON/OFF switch cycle, for example, can allow for the selection of the next program, while a longer ON/OFF switch cycle may cause the device to reset to the initial, or "number one," program, e.g., a particular color or particular color series for display. Continued brief ON/OFF cycling will typically toggle through predetermined, select programs stored in the light fixture control or the device control until eventually rolling over to the number one program. Variations in the nature of the signal, for example, pulse length, can be used to control different features, such as lighting effects. The switch cycle program method, or scheme, is typically proprietary to the particular light manufacturer and stored on a microprocessor in the controller. This is merely one known type of control method—various others exist. For example, some older control mechanisms, when manually engaged, will produce the ON/OFF sequencing to enable user control of the emitted color of the lights.

Newer methods include the use of a digital time clock in conjunction with solid state relays to control operation of the selected equipment. In accordance with this known method, the light is directly identifiable to the controller, as the commands are communicated directly from the controller to the controlled component. With the use of newer digital timers, the relays are often controlled directly, and the control inputs communicated directly to the subcomponents, which are coupled to a power block on the transformer, e.g., direct control of lighting to effect color changes using a digital signal input separate and apart from the corresponding power relays. Such system may be controlled by a controller, which is then wirelessly controlled, providing high level controls.

However, applicants are unaware of any known system capable of controlling each switch as an independently-addressable controller and coupling it wirelessly to a controller or network application. Accordingly, there is a need for such an apparatus and method of control capable of addressing each switch individually, in a wired and/or wireless manner, to control the power and other functions associated with such low voltage devices.

Furthermore, existing controllers are often insufficiently feature rich, unable to communicate with newer remote controls, and/or unable to communicate through web-enabled devices. Accordingly, it would be highly desirable to provide such a system that could be employed to retrofit such older existing equipment. For example, it would be highly desirable to be able to utilize an existing mechanical enclosure by retrofitting a conventional mechanical time clock based control system with a more feature-rich digital control system. Utilizing the existing enclosure, such a retrofittable system would allow for the existing wiring to be reused, in lieu of having to install new wiring, and simply replaces the existing relay, switch block, or equivalent switching/relay device.

The concept of retrofitting digital controllers into an existing mechanical enclosure in existing solutions provides only limited functionality. In these cases, the low voltage systems, such as the lights, are simply wired to a transformer box with a physical power switch controlling the power. To date, no existing digital or mechanical control timer systems are known that are capable of communicating with the internet or being internet-controlled at the relay level wherein each relay is individually addressable, thereby offering wireless remote control or wired weatherproof remote control, much less providing a power interruption mechanism or relay coupled to the low voltage side of a power transformer in a control circuit of the controller to control the low voltage equipment.

Furthermore, the need exists for such a control system enabling convenient control of devices with a greater degree of particularity, such as the separate/individual control of the display of lighting colors, programs, or patterns of operation at the individual relay level, as well as incorporating relays to switch power in the required format to enable programmed switching. Preferably, such a device could be employed as part of a new installation and as a retrofit device for existing systems, which is capable of providing power interruption mechanisms, such as individually-addressable and individually-controllable relays coupled to the low voltage side of a power transformer of a control circuit of the controller system, and which is retrofittable to an existing control enclosure that can address each relay, individually, on the low voltage side of the transformer, providing expanded functionality to the retrofitted controller system. Preferably, this would include either on-board or off-board components to provide control of one or more relays and/or similar control devices providing a pathway for communication with and/or control via the internet using a suitable software interface application and user interface. Preferably, the system would be adapted to enable wireless control, wired weatherproof control, and/or two-way communication with the controller(s) of controlled loads, while providing a power interruption mechanism coupled to the low voltage side of a power transformer of a control circuit of the controller.

SUMMARY OF THE INVENTION

The present invention provides a solution to the aforementioned drawbacks, disadvantages, and limitations by providing such an apparatus and associated methods of use/operation that integrates a device with a conventional transformer box, wherein the device interfaces with a wireless dongle and controls the LED lights and other low voltage sub-components with a directly-addressable switching unit. In accordance with one implementation of the present invention, the apparatus, or device, is provided in the form of an independent enclosed unit, functioning as a complete drop-in replacement for existing switching devices and controllers. In accordance with an alternative implementation of the present invention, the apparatus, or device, may be employed as a direct replacement for one or more conventional switching devices and controllers within existing enclosures.

Furthermore, in accordance with an associated method of operation, or use, of the present invention each individual one of a plurality of low voltage devices can be separately, or independently, addressed to enable the control of different groups or triggers, thereby enabling a user to selectively control individual lights or groups of lights, or similarly-operated low voltage devices; for example, in a pool, spa, and water feature combination wherein a variety of different lighting modes are desired with independent groups of lights and/or landscape lighting and features.

Furthermore, the present invention provides a controller and associated methods of using the controller for monitoring power consumption, current, and voltage from the corresponding lighting products, as well as corresponding control and scheduling.

In accordance with one aspect of the present invention, a pool or spa controller is provided having an individually-addressable relay for each light or subcomponent, which enables a power-on control scheme and reporting capabilities to a controller and, thereby, a user interface.

In another aspect, a pool or spa controller is provided having an individually-addressable relay, including, but not limited to, a Silicon Controlled Relay (SCR) or TRIode for Alternating Current (TRIAC), for each light or subcomponent, which enables direct operational control and reporting capabilities to a controller and, thereby, to a user interface.

In another aspect, the apparatus of the present invention provides a retrofittable pool, spa, or water feature lighting controller with power scheduling and power monitoring capabilities, which can be directly substituted for existing switching devices.

In another aspect, the apparatus of the present invention provides a pool, spa, or water feature controller that directly reports the condition, or state, of a switch, and controls the switch as a wirelessly-addressable switch, the apparatus including relays incorporating power monitoring sensors to monitor and manage power usage, scheduling operations, and power/control via addressable relays associated with one or more pool, spa, and/or water feature devices.

In another aspect, the apparatus may incorporate relays having any of a variety of switch pole and throw configurations, including, for example: Single-Pole Single-Throw (SPST) switches; Double-Pole Double-Throw (DPDT) switches; Single-Pole Double-Throw (SPDT) switches; and Double-Pole Single-Throw (DPST) switches. As used herein, the term "pole" refers to the number of circuits controlled by the switch (e.g. Single-Pole (SP) switches control only one electrical circuit, while Double-Pole (DP) switches control two independent circuits (and act like two identical switches that are mechanically linked). The term "pole" is unrelated to the term "terminal." The DPST switch, for example, has four terminals, but it is a DP switch, not a 4P switch. As used herein, the term "throw" refers to the extreme position of the actuator. Single-Throw (ST) switches close a circuit at only one position (e.g. an UP position). The other position (e.g. a DOWN position) is OFF. Double-Throw (DT) switches close a circuit in both positions (e.g. UP and DOWN positions). A DT switch can also have a center position (e.g. ON-OFF-ON).

In a further related aspect, it is contemplated that the apparatus may incorporate electronic devices analogous to relays, such as an SCR or TRIAC. As those skilled in the electronics are will recognize, an SCR (Silicon Controlled Rectifier), commonly referred to as a "Thyristor," is similar in construction to a transistor. It is a multi-layer semiconductor device, requiring a gate signal to turn it "ON" (i.e. the "controlled" part of the name) and once "ON" it behaves like a rectifying diode (i.e. the "rectifier" part of the name). Unlike a junction diode, which is a two-layer (P-N) semiconductor device, or the commonly used bipolar transistor, which is a three-layer (P-N-P or N-P-N) switching device, the SCR is a four-layer device, unidirectional device (i.e. it will only conduct current in one direction) that contains three PN junctions in series. However, unlike a diode, the SCR can be made to operate as either an open-circuit switch or a rectifying diode depending upon how the SCR's gate is triggered. The SCR is one of several power semiconductor devices along with TRIACs, DIACS (Diode ACs), and UJTs (Uni-Junction Transistors) that are all capable of acting like very fast solid state AC switches for controlling large AC voltages and currents. So, this makes them very handy solid state devices for controlling AC motors, lamps and for phase control. Again, as will be apparent to those skilled in the electronics arts, a TRIAC (TRIode for Alternating Current) refers to a three-terminal electronic component that conducts current in either direction when triggered. Its formal name is "bidirectional triode thyristor" or "bilateral triode thyristor." A thyristor is analogous to a relay in that a small voltage and current can control a much larger voltage and current. TRIACs are a subset of thyristors and are related to SCRs. TRIACs differ from SCRs in that they allow current flow in both directions, whereas an SCR can only conduct current in a single direction.

In another aspect, a fully-retrofittable block or set of one or more relays may be provided coupled to the low voltage side of a transformer with a controller for placement in an existing transformer box and electrically coupled to existing power lines and equipment leads.

In another aspect, the apparatus may be provided in the form of a replacement transformer box and controller having a block or set of one or more relays coupled on the low voltage side of a transformer with a controller to be substituted in place of an existing transformer box and electrically coupled to power lines and equipment leads.

In another aspect, the apparatus may provide a control system incorporating a direct control scheme and switched on the low voltage side of the transformer to operate a low voltage device, wherein the control system is coupled to the device and the controller in a manner providing the option of further wired and wireless communication from the control system.

In another aspect, a control system may be provided utilizing a "power on" control scheme and switched on the low voltage side of the transformer to operate a low voltage device, wherein the control system is electrically coupled to the low voltage device and the controller in a manner providing the option of further wired and wireless communication from the control system.

In an exemplary implementation, an apparatus, method for operating the apparatus, and method for using the apparatus to control low voltage devices is provided. The apparatus may include a light control system in a pool, spa, or water feature having a controller, with a power source electrically coupled to a power input of the control system, a transformer electrically coupled to the power input for converting the power input from a high-voltage alternating current (AC) input on a first side of the transformer circuitry to a low-voltage source on a second side, and at least one power interruption mechanism electrically coupled to the low voltage side of the power transformer in a control circuit of the controller. The power interruption mechanism(s) may have at least one relay electrically coupling the low voltage side of the transformer output to a load powered by the control system and controlled by the controller such that the power to the load can be selectively interrupted by the relay upon receipt of a signal from the controller.

The system may further include a communication-receiving element/circuit adapted or otherwise configured for receiving element/circuit receiving communication signals for control of the connected load. The power interruption mechanism(s) may be configured to enable interruption on one pole or both poles of an AC power input. The relay may be a mechanical relay or a solid state switch having a SPST, SPDT, DPST or DPDT type switch. The power interruption mechanism may act on all three poles of the low voltage input. Furthermore, as noted hereinabove, in lieu of such relays an SCR and/or TRIAC may be employed.

In accordance with an aspect, the controller may be implemented to control one or more lights associated with a pool, a spa, a water feature, landscaping, or other low voltage lighting device employed in proximity to a pool/spa area. The device may be implemented as a retrofit within an existing transformer chassis or, alternatively, provided within its own enclosure as a newly-installed device.

In another aspect, multiple power interruption mechanisms may be provided electrically coupled in parallel with the same low voltage side of the transformer. Each power interruption mechanism may be configured as an individually addressable mechanism utilizing logic addressing or physical addressing.

In another aspect, the controller may be communicatively coupled to a network in a manner enabling the control of system power loads connected to the controller. The controller may be communicatively coupled via a wired connection such as an RS-485 connection. RS-485 is a standard defining the electrical characteristics of drivers and receivers used in serial communications systems, wherein electrical signaling is balanced, and multipoint systems are supported. Alternatively, the controller may include a Wi-Fi board, or Wi-Fi module, to enable and facilitate communicative coupling using conventional wireless (Wi-Fi) connectivity. Each power interruption mechanism may have a power monitoring circuit capable of reading data on the power drawn by the load connected by the power interruption mechanism. One or more data storage devices may be provided for storing the aforementioned read data, including, for example, energy consumption of the load and efficiency information.

In accordance with a particular exemplary implementation, the apparatus of the present invention may be provided in the form of: a light controller in a low voltage pool, spa, or water feature device having a device controller; a relay controller communicatively coupled to the device controller and controlling an individually-addressable power relay having an opened state/condition and a closed state/condition for selectively powering the individually-addressable power relay; a power source electrically coupled to the individually-addressable power relay on an input side of the relay; a light (i.e. light-emitting component) electrically coupled to the output of the individually-addressable power relay on an output side of the relay such that the power relay effectively controls power to the light in the opened and closed states; and a control input issued from the controller, wherein the control input controls the opening and closing of the power relay between its opened and closed states in order to effect the powering on and off of the light—thereby, changing the color emitted by the light-emitting component.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate, but not to limit, the invention, in which.

Like reference numerals refer to like parts throughout the several views of the drawings.

DETAILED DESCRIPTION OF EXEMPLARY IMPLEMENTATIONS

Figure 1:
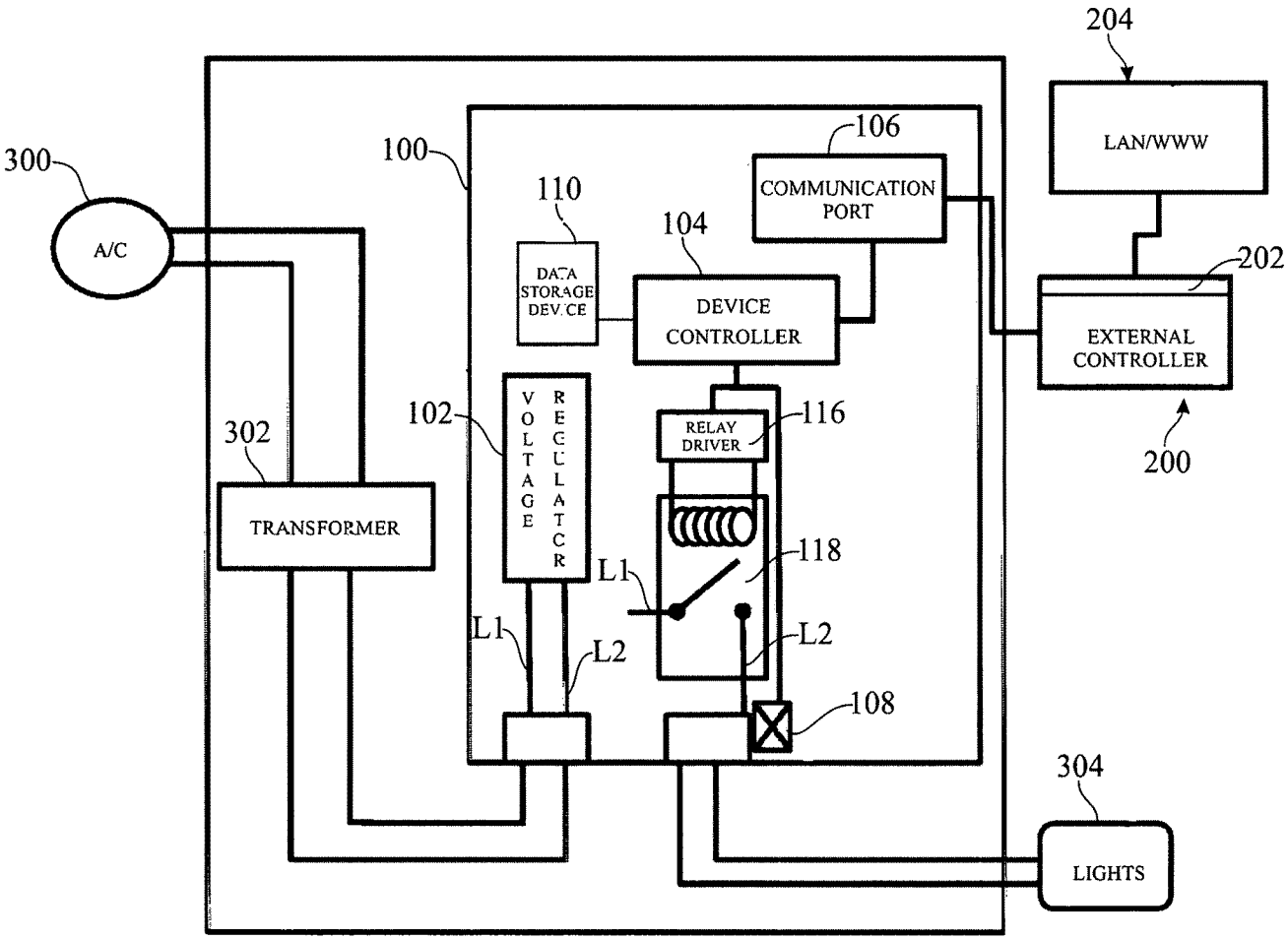
FIG. 1 presents an electrical circuitry schematic illustrating the incorporation of an external wired network communications package, in accordance with an exemplary implementation of the invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

References herein to a "light" or to "lights" are intended to include any lighting commonly associated with, or integrated within, devices in a swimming pool, spa, pond or water feature (e.g., fountains, waterfalls, deck jets, bubblers, etc.), any landscape-related lighting, as well as music or other entertainment devices related thereto. Any references made herein to "a light" or "a device" should be construed to mean "at least one" light or device, respectively. Likewise, although reference may be made to a single light or device in the drawing figures it will be readily apparent that multiple replications of the invention can provide for control of multiple lights and/or multiple devices. Likewise, although depicted with respect to a unitary light, the control system can include individual devices or fixtures as well as entire zones of multiple fixtures of such devices. Similarly, references herein to a "relay" are not intended to be so limiting. For example, as described in further detail elsewhere herein, references to a "relay" are intended to include, for example, SPST, DPDT and similar switches, as well as devices analogous to relays, such as SCR-based and TRIAC-based electrical switching methods.

The present invention is generally directed to an improved controller that can be produced as a retrofit replacement for existing controller systems or, alternatively, as a complete new unit for controlling low voltage sub-components, such as, but certainly not limited to, lighting, fountains, waterfalls, deck jets and other water features, landscape lighting, and music or other entertainment devices related thereto.

The invention provides for control of an individual relay as an addressable terminus, switch, relay, or power-interrupting mechanism enabling the control of the powered load. In accordance with an exemplary embodiment, the relay or power interrupting mechanism is located on the low voltage side of a circuit following the transformer. In accordance with a further exemplary embodiment, each control circuit for each respective relay is further provided with a power management circuit to enable monitoring of the quality, amount, and additional related parameters associated with the power supplied via the relay. The improved control system of the present invention provides heretofore unseen levels of control of the various connected subcomponents within a typical pool environment. The novel control system also enables the collection and storage of power-related data at the component level, while providing a user with the ability to monitor power consumption and schedule peak power consumption functions during non-peak utility times. The control system also provides real time performance and efficiency feedback of the system, which can be integrated with the scheduling of operations. Consequently, not only can scheduling of system operations be made such that peak power consumption is made to coincide with off-peak utility hours during a given day, but also based upon daily, weekly, or similar operational profiles. This control can be applied to any lighting and may also include overrides for manual operations. These and other scheduling features are described in greater detail herein, with reference to exemplary embodiments, or implementations, shown in the accompanying figures and with reference to corresponding exemplary methods of operation.

Referring now to FIG. 1, an electrical schematic representation of an exemplary embodiment of the invention incorporating an external wireless communications package is shown. An alternating current (AC) source 300 is provided to the control system 100, representing the AC main from a typical household power supply. A transformer 302 is provided to transform the AC power input from the AC source 300 into a lower voltage power source required to operate the low voltage control system 100. The transformer is the power behind every low-voltage system. It plugs into a GFCI-protected outdoor electrical outlet and steps down the house current from 120 volts to 12 volts. Transformers are rated according to the maximum wattage output. Most range from about 44 watts to about 900 watts. In electrical power distribution, the United States 2005 National Electrical Code (NEC) defines low (distribution system) voltage as 0 to 49 volts.

As is further shown in FIG. 1, the control system 100 includes at least two connection leads L1 and L2, which are coupled to a relay 118 via a voltage regulator 102. A voltage regulator is an electronic circuit that provides a stable direct current (DC) voltage independent of the load current, temperature and AC line voltage variations. In this manner, it is designed to automatically maintain a constant voltage level. The L1 connection lead couples to the voltage regulator 102 and is further coupled to the relay 118. Although only one relay 118 is depicted in FIG. 1, this is merely for convenience. That is, more than one relay 118 may be employed—as depicted FIGS. 3 and 4 and described herein with regard to alternate embodiments of the present invention.

The control system 100 incorporates a device controller 104 and communication port 106 to control the circuit incorporating the relay 118. The device controller 104 interfaces with a relay driver 116 and relay 118, and is further coupled via the communication port 106 to an external controller 200. Alternative embodiments, or implementations, described hereinbelow (and depicted in the corresponding drawing figures) provide for a variety of alternative controller and communications configurations. Still referring to the exemplary embodiment of FIG. 1, the external controller 200 or device controller 104 provided can be used to implement a series of protocols to maintain schedules, produce selective lighting sequences, store data specific to the controlled nodes, monitor energy consumption (as elaborated upon in more detail hereinbelow), and provide related data and information in accordance with the operation of the exemplary relay 118 being controlled.

The external controller 200 may also include a network communications device 202 and, thereby, couple to a network 204. The network communications device 202 can be connected, wired and/or wirelessly, to the network 204 to enable communication therebetween. The network 204 may include, but is certainly not limited to, a LAN, WAN, Wi-Fi network, Wi-Max network, Bluetooth network, PICONET network, home network, internet, cellular system network, PCS system, satellite network, or any other similar communications network. Again, the network communications device 202 provides connection to the network 204, which may subsequently provide an interface with a user interface (not shown) to enable user command and control. As described in greater detail below, corresponding software can be installed on the device, or pushed to the device, via the wireless network as an application ("app") or similar software to appear on the device to control the light controller through the network 204. Similarly, a hard-wired or imbedded graphical user interface, or GUI (not shown), can be provided at or proximate to the light controller.

Relay 118 switches connection L1 to the load when commanded by device controller 104. Although the exemplary relay(s) 118 shown in accompanying FIGS. 1-4 are depicted as Single-Pole Single-Throw (SPST) relays, the invention is not intended to be so limiting. Alternative relay configurations are contemplated (e.g., depending upon the type of device being controlled, the control scheme being implemented, and like parameters of the particular control circuit needed), including, for example, Single-Pole Double-Throw (SPDT), Double-Pole Double-Throw (DPDT), and other relay configurations. By implementing single- and multi-pole to multi-pole switches, various embodiments can be implemented to embrace different modes and configurations for each relay, which can then be set for the multiple positions. Similarly, the relays 118 may comprise analog or solid state switches or relays, including, but not limited to, electromagnetic relays, reed relays, hybrid relays, thermal relays, Metal Oxide Semiconductor Field Effect Transistor (MOSFET) relays, TRIAC- and SCR-based devices and similar analog and solid state relays.

Device controller 104 can implement ON/OFF timing characteristics on the low voltage side of the system for a variety of lighting products, wherein the control or selection of the ON/OFF timing characteristics or control scheme can be adjusted via input from the external controller 200, which, in turn, can receive input from an external user interface (not shown) via the network 204. The user interface can be implemented wirelessly through one or more wireless enabled devices, such as, for example, a portable smartphone, electronic tablet, computer, or the like. The software used from the external interface can be installed on any of the aforementioned devices or pushed to it through the wireless network as an application (i.e. "app") or similar software to appear on the device to control the light controller 100 via the network 204. Similarly, a hard-wired or imbedded graphical user interface, or GUI (not shown), can be provided at or in close proximity to the light controller. The software or GUI may provide access to controls as enumerated hereinbelow, which may include, but are not limited to, monitoring power consumption, programmed light effects, programmed schedules of operation, pre-programmed "shows" and the like, as well as other aspects for controlling devices connected to the relays. Additionally, in further exemplary embodiments, a different control schemes can be utilized to control the components and their functions. For instance, these may include direct communication with the device having its own controller at the device level, or further line inputs, which may be implemented through the aforementioned SPDT, DPDT, and nPnT type switching devices and corresponding inputs at the load.

Still referring primarily to FIG. 1, the controller system 100 may further include a power monitoring circuit 108. The power monitoring circuit 108 not only monitors the amount of current cycling throughout the system, but also the nature/quality of the current and, thereby, the power that is provided and being shunted by the relay 118 to the resulting device or terminus. Monitoring may include monitoring the overall current being utilized on the relay 118, the overall power consumption, the component power consumption, the quality of the power provided, and similar data on the power and how it is being used. For example, the current monitor may be comprised of one or more of the following: a Hall-effect sensor; a fluxgate sensor; a fiber-optic current sensor, a Rogowski coil type sensor, and the like. The current monitor 108 provides for real-time monitoring of the behavior of the current at the relay, enabling a number of desirable features relative to the method of monitoring and operations described in further detail below.

The controller 100 can therefore also include the capacity to monitor and report energy or power usage and various parameters describing the quality of the energy supplied to the light(s). It may also enable direct control over the "powering on" function and communication with the various elements coupled via the communications port 106. This may include, for instance, scheduling operation times, scheduling maintenance periods, controlling operating modes, controlling operating parameters (e.g., brightness, color, etc.), controlling power consumption, controlling power usage, controlling overall power costs, and the like. The power monitor circuit 108, along with the data it collects, can also be utilized, as elaborated upon hereinbelow, to enable an end user to monitor energy efficiency in real time and adjust the systems operations to maximize energy savings, for instance, by coordinating the scheduling of peak consumption operations with off-peak utility hours.

Through the network 204 or through direct control at the external controller 200, the control system 100 may report, or be polled by, a user interface device (not shown) such as, for example, a portable smart device, or similar interface, via the network 204 or through direct coupling with the external controller 200. This enables interaction with the controller 100 and any of the light(s) 304 it controls. In addition, the user interface device can provide for presentation of data regarding the light as sensed through the power monitoring circuit 108, the individual settings and operational information for the light 304, historical data that is stored regarding the light(s) 304, and energy consumption and efficiency information. A memory storage device 110, such as, a random access memory (RAM), a hard drive, a solid state device, a wireless network connection for cloud storage, or any similar data storage media can be utilized to store the data. In accordance with the exemplary embodiment of FIG. 1, a discrete micro solid state drive (SSD) is provided.

Figure 2:
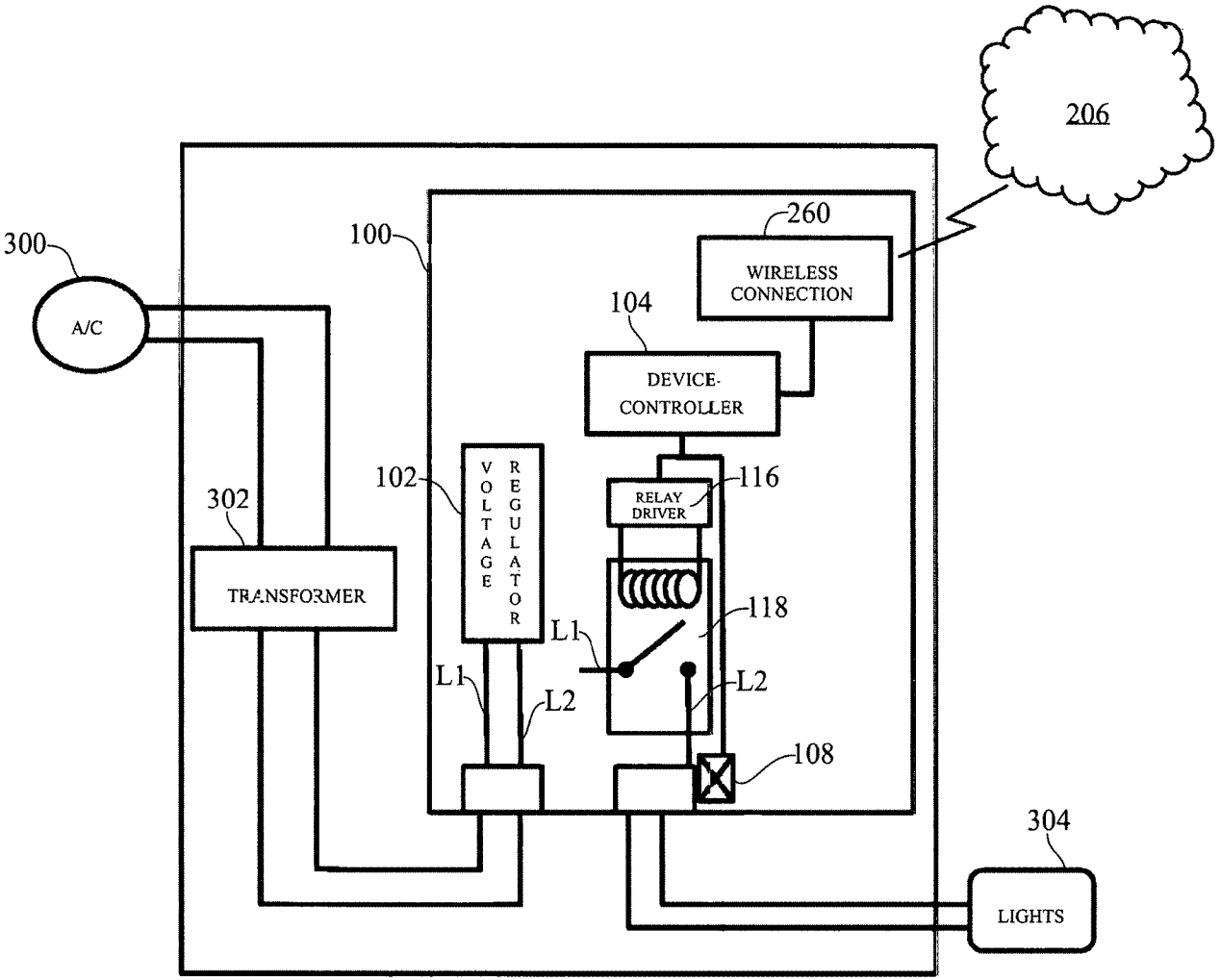
FIG. 2 presents an electrical circuitry schematic illustrating the incorporation of an on-board wireless communications package, in accordance with an alternative exemplary implementation of the invention.

Referring now to FIGS. 2 through 5, and primarily to FIG. 2, alternative exemplary embodiments of the present invention are shown. Like features of the system, as originally introduced in FIG. 1, are numbered the same. The embodiment shown in FIG. 2 is similar to the exemplary embodiment originally introduced in FIG. 1, with the exception that the network communication device 202, coupling external controller 200 to network 204, and the communication port 106 are substituted with an on-board wireless connection device 260 (FIG. 2) within the controller device 100 in this exemplary embodiment. The wireless connection device 260 may, for example, be a transceiver that is configured to enable communication with a network, such as network 204 (FIG. 1) or a terrestrial wireless network 206 (FIG. 2). The wireless connection device may be integrated on the printed circuit board (PCB), or mother board, housing the device controller 104 or, alternatively, on a separate daughter board.

Figure 3:
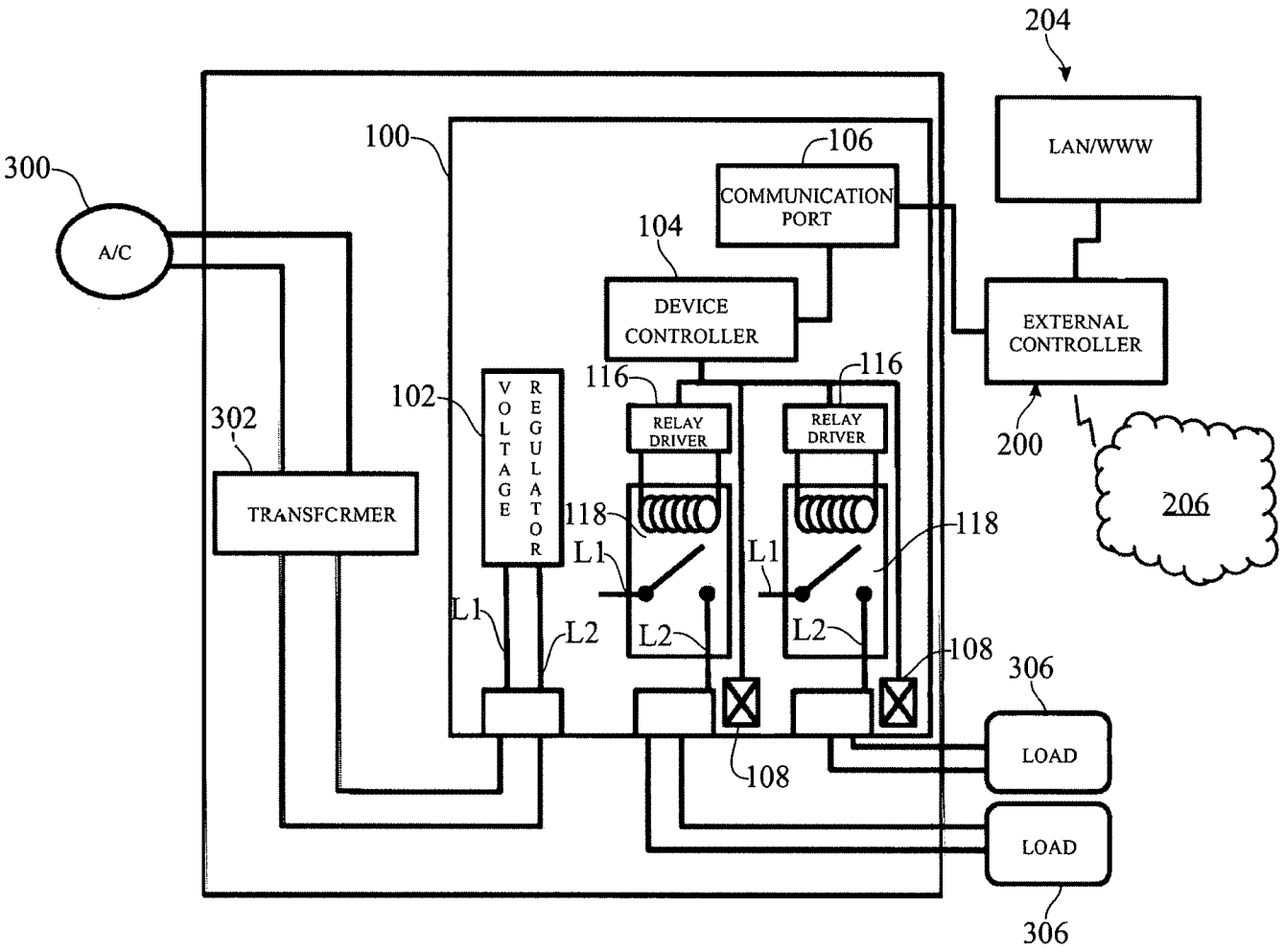
FIG. 3 presents an electrical circuitry schematic illustrating the incorporation of both an external wired network communications package and an on-board wireless communications package, and having multiple addressable relays, in accordance with another alternative exemplary implementation of the invention.

Referring now to FIG. 3, in a further representative implementation of the present invention, a further exemplary embodiment is shown having multiple addressable relays 118. The device controller 104 is shown having multiple corresponding relays 118 and loads 306 (e.g., light fixtures, water features, etc.) coupled to, and controlled by, the system controller. Such a device enables and facilitates independent control and setting of the relays 118 based, for instance, on the control scheme for the light and the lighting scene selected. This enables implementation of multiple "zones" of lights, multiple configurations of various pool devices with lighting (e.g., lights in waterfalls, deck jets on one relay set and in pool lights on another relay set), and similar complex configurations requiring multiple controls of lights in one or more devices. Significantly, as noted above with respect to the relays 118, each relay is addressable by the device controller 104. This can be accomplished via logical addressing or physical addressing (as noted below), while enabling the control of individually-regulated components coupled to the relays. In other words, each light fixture, water feature, and the like, can be independently and selectively addressed and configured into a user-specific configuration via a controller.

Figure 4:
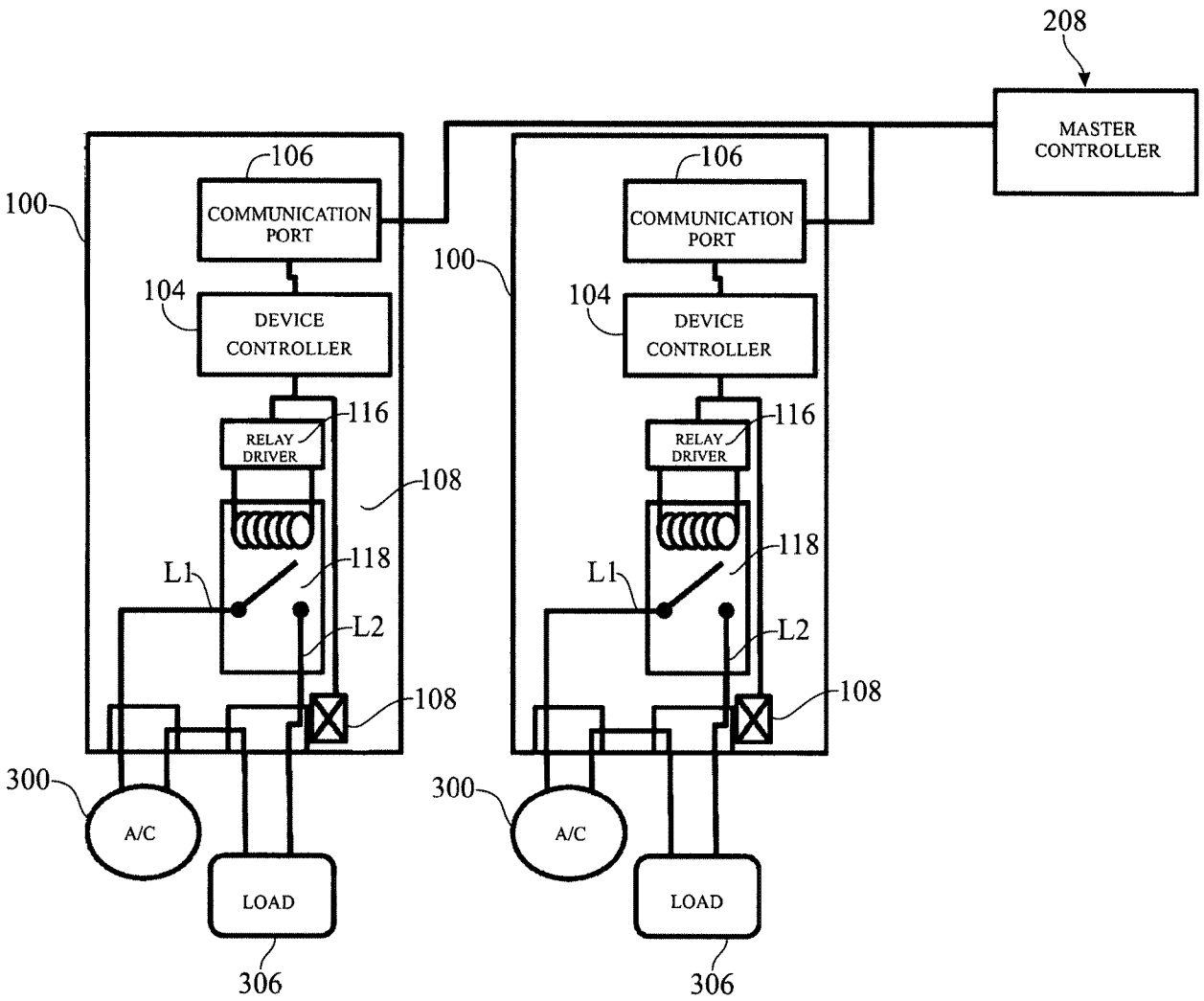
FIG. 4 presents an electrical circuitry schematic of a further alternative exemplary implementation of the invention, incorporating a pair of the controllers (100) presented in FIG. 3 and a master controller (208) shown in place of the generic external controller (200) presented in FIG. 3.

Referring now primarily to FIG. 4, in accordance with yet a further representative implementation of the present invention, an exemplary embodiment of the instant invention, multiple device controllers 104 and a master (external) controller 208 are generally shown. This particular embodiment shows multiple devices with their corresponding subcomponents similar to the exemplary embodiment of FIG. 1, each connected concurrently to a common external/master controller 208 via its respective communication port 106. In such a setup, each device is capable of carrying a unique address that is programmed via its respective communication port 106 (i.e. logical addressing) or via dual in-line package (DIP) switches on the device (i.e. physical addressing). Again, this configuration enables multiple devices, lights or loads, "zones of lights," multiple configurations of various pool devices with lighting (e.g. lights in waterfalls, deck jets on one relay set and in pool lights on another), and similar complex configurations requiring multiple controls of lights in one or more devices.

Figure 5:
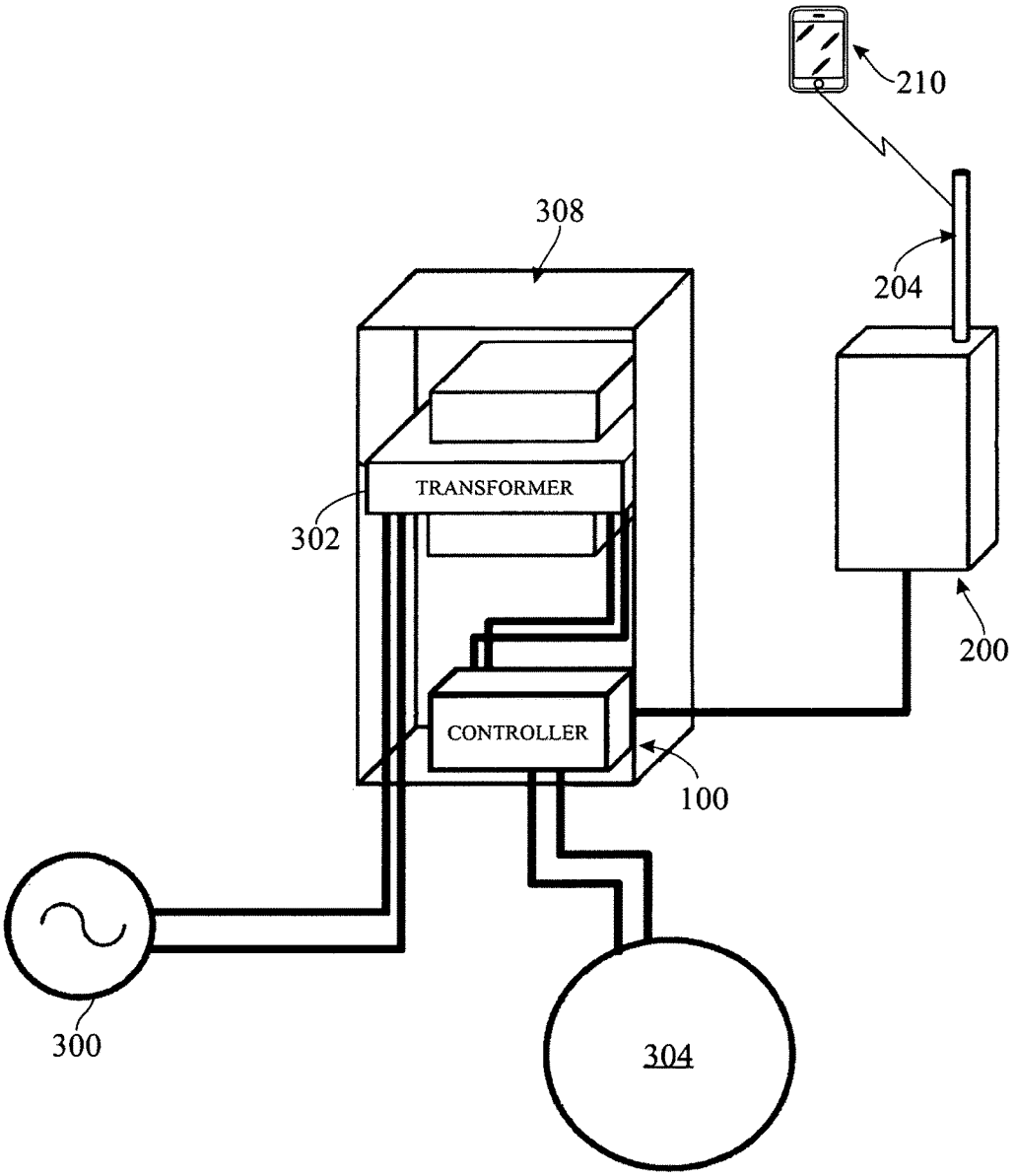
FIG. 5 presents a schematic view of an exemplary implementation of the present invention, wherein the controller, or control system (100), and transformer (302) are depicted integrated within an existing transformer box (308), with the transformer (302) shown interposed between an alternating current (AC) source (300) and control system (100), and the control system (100) shown communicatively coupled to transformer (302), external controller (200), and lighting (304).

Referring now primarily to FIG. 5, a schematic representation of yet another exemplary implementation of the present invention is shown. In this representative illustration, the controller device 100 is provided within an existing transformer box 308, making it adaptable, and therefore a candidate, for a retrofit solution. A specially designed box (not shown) can also be utilized as a complete replacement version of existing transformer and controller elements in a further embodiment. The control system 100 shown in FIG. 5 is communicatively coupled to an AC connection 300, through a transformer 302, to at least one light 304 and the wireless connection point 204 of external controller 200.

In accordance with the operation of the exemplary embodiments of the system, as shown in FIGS. 1-5, the control system 100 may be retrofitted in such a manner to replace one or more existing relays and device controllers, or, alternatively, in the form of a complete new unit for installation. The energy from the high voltage AC power source 300 is coupled to the controller system 100 as previously described vis-à-vis the aforementioned embodiments. Power is provided from the low voltage side of the transformer 302 to at least one relay 118 being controlled by a respective relay driver 116 which, in turn, is controlled by controller 100—thereby, selectively coupling the relay 118 to the L1 line in. In this manner, powering (i.e. ON or OFF) of the light 304 can be monitored and controlled at the relay level. The further current monitor 108 is also provided to detect the quantity and quality of the provided current. The various modes of the light 304 can be accessed and controlled by the controller 100, and via the communication port 106 coupled to an external controller 200. The corresponding modes or light shows may be activated using control inputs on the external controller 200 or through a wireless user interface or other means.

One or more loads 304 may be selected by the controller 100, selectively engaged based upon a control scheme stored within the controller 100 or, alternatively, inputs from the controller may be used to activate a controller on the device or load 304. One such control scheme utilizes powering on/off the relay(s) 118, with various parameters to achieve desired results on the load(s). Similar control may be achieved through a more complex switching or relay device having one or more poles and corresponding throws to activate the load(s) or device 304. Still a further control paradigm may be achieved through direct communication of the controller 200 with a corresponding controller on the load(s) or device(s) 304 to operate the load in a variety of modes.

The various configurations and controls may include different effects, modes, colors, and the like, being displayed in the load, which may, for example, take the form of lighting, fountains, waterfalls, deck jets, and related water features, landscape lighting, and music or related entertainment devices, and any other similar low voltage device. The combination of operations of these devices, together or individually, can also be maintained (i.e. stored in memory) on the controller 200. The individual components, loads or devices, can be maintained stored on the controller and their respective operations selectively altered by user input via a user interface, as previously described.

The subject matter of embodiments of the present invention is described here with specificity to meet statutory requirements, but this description is not necessarily intended to limit the scope of the claims. The claimed subject matter can be embodied in other ways, can include different elements or steps, and can be used in conjunction with other existing or future technologies. This description should not be interpreted as implying any particular order or arrangement among or between various steps or elements except when the order of individual steps or arrangement of elements is explicitly described. The embodiments and examples discussed herein are non-limiting examples. The invention is described in detail with respect to preferred embodiments, and it will now be apparent from the foregoing to those skilled in the art that changes and modifications can be made without departing from the invention in its broader aspects, and the invention, therefore, as defined in the claims is intended to cover all such changes and modifications as fall within the true spirit of the invention.

What is claimed is:

1. A light control system for controlling low voltage lighting associated with pools and surrounding landscaping, as well as related landscape and water features, and related music and entertainment devices, the light control system powering a load and comprising:

a controller having a power input and a control circuit;

a power source communicatively coupled to the power input of the light control system;

a power transformer, having power transformer circuitry, communicatively coupled to the power input of said controller, said power transformer effectively converting said power input from a high voltage AC input on a high voltage side of said power transformer circuitry of said power transformer to a relatively low voltage power output source on a low voltage side of said power transformer circuitry; and at least one power interruption mechanism electrically coupled to said low voltage side of said power transformer in said control circuit of said controller having said second lower voltage of said power transformer, said at least one power interruption mechanism having at least one independently-addressable power interruption mechanism relay coupling said low voltage side of said transformer output source to the load powered by the light control system and controlled by the controller such that the power source to the load can be selectively interrupted by the at least one power interruption mechanism relay upon receiving a signal from the controller.

2. A light control system as recited in claim 1, further comprising:

a communication receiving element/circuit receiving communication signals for controlling the connected load.

3. A light control system as recited in claim 1, said at least one power interruption mechanism interrupting power on a first pole of an alternating current (AC) power input.

4. A light control system as recited in claim 1, said at least one power interruption mechanism interrupting power on both a first pole and a second pole of an alternating current (AC) power input.

5. A light control system as recited in claim 1, said at least one power interruption mechanism relay further comprising at least one of:

a mechanical relay; and a solid state switch.

6. A light control system as recited in claim 5, said at least one power interruption mechanism relay further comprising further comprising a Single-Pole Single Turn (SPST) relay.

7. A light control system as recited in claim 5, said at least one power interruption mechanism relay further comprising further comprising a Double-Pole Double-Turn (DPDT) relay.

8. A light control system as recited in claim 1, said at least one power interruption mechanism interrupting power on all poles of a 3-Pole low voltage power source.

9. A light control system as recited in claim 1, said controller controlling at least one of:

a pool light;

a landscape light; and at least one non-pool, non-landscape low voltage device.

* * * * *